US008844171B2

(12) United States Patent
Eder et al.

(10) Patent No.: US 8,844,171 B2
(45) Date of Patent: Sep. 30, 2014

(54) ARTICLE OF FOOTWEAR WITH A BALL CONTACTING SURFACE

(75) Inventors: Collin K. Eder, Portland, OR (US); Windra Fahmi, Beaverton, OR (US); Sebastien Mermet, Creteil (FR); Morgan Stauffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 632 days.

(21) Appl. No.: 12/755,694

(22) Filed: Apr. 7, 2010

(65) Prior Publication Data

US 2011/0247240 A1 Oct. 13, 2011

(51) Int. Cl.

| | |
|---|---|
| ***A43B 5/00*** | (2006.01) |
| ***A43B 23/00*** | (2006.01) |
| ***A43B 5/02*** | (2006.01) |
| ***A43B 1/00*** | (2006.01) |

(52) U.S. Cl.

CPC ..... *A43B 5/02* (2013.01); *A43B 1/0009* (2013.01); *A43B 5/025* (2013.01)

USPC ..... 36/133; 36/132; 36/136

(58) Field of Classification Search

CPC ..... A43B 1/0009; A43B 3/00; A43B 5/02; A43B 5/025; A43B 23/00; A43B 23/0225; A43B 23/0265

USPC ..... 36/133, 114, 72 R, 128, 132, 124, 129, 36/77 R, 134, 45, 136

See application file for complete search history.

(56) References Cited

U.S. PATENT DOCUMENTS

| | | | | |
|---|---|---|---|---|
| 2,661,547 | A | 12/1953 | Hyde et al. | |
| 3,191,321 | A * | 6/1965 | Brutting | 36/133 |
| 3,525,165 | A * | 8/1970 | Richmond Jr. | 36/133 |
| 3,650,051 | A * | 3/1972 | Sass | 36/133 |
| 4,422,249 | A * | 12/1983 | Hannah | 36/133 |
| 4,442,615 | A * | 4/1984 | Danks | 36/133 |
| 4,617,746 | A | 10/1986 | Hannah | |
| 4,711,043 | A * | 12/1987 | Johnson et al. | 36/139 |
| 4,899,470 | A | 2/1990 | Holland, III | |
| 5,437,112 | A * | 8/1995 | Johnston | 36/128 |
| 5,894,685 | A | 4/1999 | Yates | |
| 5,897,446 | A * | 4/1999 | Wiseman et al. | 473/446 |
| 6,421,936 | B1 | 7/2002 | Gerrand | |
| 6,523,282 | B1 * | 2/2003 | Johnston | 36/133 |

(Continued)

FOREIGN PATENT DOCUMENTS

| | | |
|---|---|---|
| DE | 2652055 | 5/1978 |
| EP | 0359081 | 3/1990 |
| WO | WO2005107508 | 11/2005 |

OTHER PUBLICATIONS

Izideal, Nike CTR360 Maestri AG ID Boot, http://www.izideal.co.uk/p5817524/nike-ctr360-maestri-ag-id-boot/ (printed on Nov. 3, 2010).

(Continued)

*Primary Examiner* — Clinton T Ostrup
*Assistant Examiner* — Cameron A Carter
(74) *Attorney, Agent, or Firm* — Plumsea Law Group, LLC

(57) ABSTRACT

An article of footwear with a ball contacting surface is disclosed. The ball contacting surface includes a raised peak member at the top and gripping members along a medial side. The ball contacting surface enhances the ability of a wearer to kick a ball with a low trajectory and to control the ball.

14 Claims, 15 Drawing Sheets

(56) References Cited

U.S. PATENT DOCUMENTS

| | | | | |
|---|---|---|---|---|
| 6,544,626 | B1 * | 4/2003 | Minges | 428/141 |
| 6,637,132 | B2 * | 10/2003 | Gerrand | 36/133 |
| 6,681,503 | B2 * | 1/2004 | Morle | 36/99 |
| D574,136 | S * | 8/2008 | Avar | D2/969 |
| 7,424,783 | B2 | 9/2008 | Meschter et al. | |
| 7,487,605 | B2 * | 2/2009 | Hatzilias | 36/133 |
| 7,497,035 | B2 * | 3/2009 | Kos et al. | 36/133 |
| 7,562,471 | B2 * | 7/2009 | Minami | 36/133 |
| D598,189 | S | 8/2009 | Lamont | |
| D602,235 | S | 10/2009 | Hatzilias | |
| 7,913,420 | B2 * | 3/2011 | Arizumi | 36/3 A |
| 8,196,322 | B2 * | 6/2012 | Atsumi et al. | 36/133 |
| 8,356,429 | B2 * | 1/2013 | Eder et al. | 36/133 |
| 2004/0088888 | A1 * | 5/2004 | Johnston | 36/133 |
| 2006/0101669 | A1 * | 5/2006 | Santos | 36/77 R |
| 2006/0174520 | A1 * | 8/2006 | Wu | 36/128 |
| 2006/0207125 | A1 * | 9/2006 | Dana, III | 36/45 |
| 2009/0014424 | A1 * | 1/2009 | Meschter | 219/121.69 |
| 2010/0011620 | A1 * | 1/2010 | Nakano | 36/88 |
| 2010/0077637 | A1 * | 4/2010 | Hatzilias | 36/133 |

OTHER PUBLICATIONS

Rabbitken, Nike CTR360 Maestri HG, http://rabbitsoccer.weloveshopping.com/ store/product/view/Nike__CTR360__Maestri__HG-16872019-th.html (printed on Nov. 3, 2010).

Sweet Patch Shop, Boot of the Month—Nov. 2009—Nike CTR 360 Maestri, http://www.sweetpatch.tv/index.cfm?articleid=5412 (printed on Nov. 3, 2010).

Winning.in.th, PES6 Boot-Nike CTR36O Maestri, http://www.winning.in.th/webboard/archive/index.php thread-51.html (printed on Nov. 3, 2010).

Taringa, CTR36O Maestri HG, http://new.taringa.net/posts/deportes/3873038/Futbol__-Todos__-todos-los-modelos-de-botines__.html (printed Nov. 3, 2010).

Football Crazy1,Nike CTR360 Maestri FG, http://footballcrazy1.tarad.com/product-th-349002-3309822-Nike+CTR360+Maestri+FG+Blue+black+white+%E0%B9%8 (printed Nov. 3, 2010).

Soccer-Fans, Nike CTR360 Maestri, http://www.soccer-fans.de/nike-fussballschuhe/27583-nike-ctr360-maestri.html (printed on Nov. 3, 2010).

Soccer Equipment Reviews, CTR360 Maestri, http://sccerequipmentreviews.com/2009/10/03/ctr360-maestri/ (Printed Nov. 3, 2010).

Soccer Equipment Reviews, Nike CTR360 Maestri Fabregas Viral, http://soccerequipmentreviews.com/2009/10/29/nike-ctr360-maestri-fabregas-viral/ (printed on Nov. 3, 2010).

Simplybula, Nike CTR360 Maestri, http://simplybula.blogspot.com/2009/10/nike-ctr-360-maestri-remake-for-control.html (printed Nov. 3, 2010).

* cited by examiner

ARTICLE OF FOOTWEAR WITH A BALL CONTACTING SURFACE

BACKGROUND

The present invention relates generally to an article of footwear, and more particularly to an article of footwear including a ball contacting surface.

There are many sports activities that include kicking a ball. Examples of such sports include soccer, football, rugby, Australian-rules football, and kickball. Conventional sports shoes that are available for these sports typically have an upper not very different from the uppers of other athletic shoes.

Features to optimize contact between the ball and shoe have been previously proposed. Hyde (U.S. Pat. No. 2,661,547) teaches a concave attachment to a shoe providing a pocket on the top of the foot to receive a football when it is kicked. Hannah (U.S. Pat. Nos. 4,422,249 and 4,617,746) and Gerrand (U.S. Pat. Nos. 6,421,936 and 6,637,132, and WO 2005/107508 A1) teach shoes having surfaces to optimize kicking of a ball.

Therefore, there exists a need in the art for an article of footwear that provides a ball contacting surface and allows the wearer to exhibit a degree of control over a kicked ball.

SUMMARY OF THE INVENTION

In one aspect, the invention provides an article of footwear, comprising: an upper including a forefoot region, a heel region and a midfoot region disposed between the forefoot region and the heel region; a ball contacting surface disposed on the upper of the article of footwear, the ball contacting surface including a raised peak member having a first height; wherein the raised peak member diminishes to a second height along the longitudinal axis in the direction of the forefoot region; and wherein the raised peak member diminishes to a third height along the lateral axis in the direction of a medial side of the article of footwear.

In another aspect, the invention provides an article of footwear, comprising: an upper; a ball contacting surface disposed over a portion of the upper; the ball contacting surface comprising a vamp portion including a raised peak member and a medial side portion; and wherein the ball contacting surface is formed by a substantially continuous raised overlay material extending between the medial side portion and the vamp portion.

In another aspect, the invention provides an article of footwear, comprising: an upper; a ball contacting surface disposed over a portion of a medial side of the upper; the ball contacting surface comprising a raised overlay material and a lower substrate material; the lower substrate material forming hollows between portions of the raised overlay material; and wherein the ball contacting surface includes a plurality of gripping members disposed in the hollows.

Other systems, methods, features and advantages of the invention will be, or will become apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE EMBODIMENTS

Figure 1:
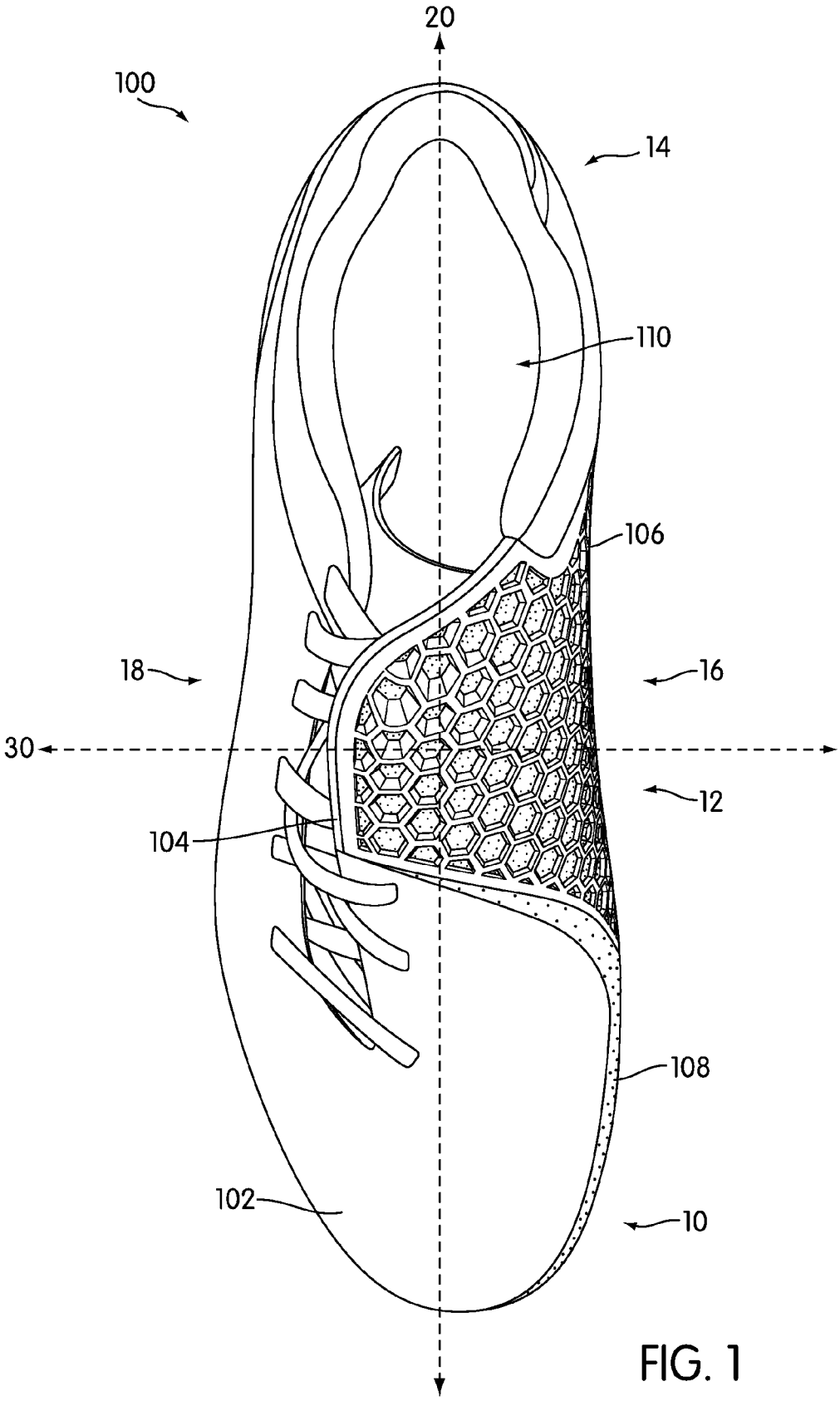
FIG. 1 is a top view of an exemplary embodiment of an article of footwear including a ball contacting surface.

FIGS. 1 through 5 illustrate views of an exemplary embodiment of article of footwear 100. For clarity, the following detailed description discusses an embodiment, in the form of a shoe for indoor soccer, but it should be noted that the present invention could take the form of any article of footwear including, but not limited to, soccer shoes, football shoes, rugby shoes, as well as other kinds of shoes.

Referring to FIGS. 1 through 5, for purposes of reference, article of footwear 100, also referred to as simply article 100, may be divided into forefoot region 10, midfoot region 12 and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include medial side 16 and lateral side 18. In particular, medial side 16 and lateral side 18 may be opposing sides of article 100. Furthermore, both medial side 16 and lateral side 18 may extend through forefoot region 10, midfoot region 12 and heel region 14.

It will be understood that forefoot region 10, midfoot region 12 and heel region 14 are only intended for purposes of description and are not intended to demarcate precise regions of article 100. Likewise, medial side 16 and lateral side 18 are intended to represent generally two sides of an article, rather than precisely demarcating article 100 into two halves. In addition, forefoot region 10, midfoot region 12 and heel region 14, as well as medial side 16 and lateral side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot region to a heel region of the article. Also, the term "lateral" as used throughout this detailed description and in the claims refers to a direction extending a width of an article. In other words, the lateral direction may extend between a medial side and a lateral side of an article. It will be understood that each of these directional adjectives may be applied to individual components of an article, such as an upper and/or a sole structure.

Referring to FIG. 1, article of footwear 100 may include a longitudinal axis 20 extending the length of article of footwear 100 from forefoot region 10 to heel region 14. Article of footwear 100 also may include a lateral axis 30 extending the width of article of footwear 100 between medial side 16 and lateral side 18.

Article of footwear 100 may include upper 102. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper. Generally, upper 102 may be made from any suitable material, including but not limited to, for example, nylon, natural leather, synthetic leather, natural rubber, or synthetic rubber. In some cases, upper 102 can be made of any suitable knitted, woven or non-woven material.

In some embodiments, article 100 may include vamp portion 104. The term "vamp portion" as used throughout this detailed description and in the claims generally refers to a portion of upper 102 extending through midfoot region 12. Vamp portion 104 may extend to entry hole 110 of upper 102. In some embodiments, vamp portion 104 may include a ball contacting surface 106. In some embodiments, ball contacting surface 106 may be used to enhance the ability to contact and control the ball when kicked. Generally, ball contacting surface 106 may be associated with any portion of upper 102. In some cases, ball contacting surface 106 may be associated with midfoot region 12 of upper 102. In some embodiments, ball contacting surface 106 may extend from medial side 16 to the top of upper 102. In an exemplary embodiment, ball contacting surface 106 extends substantially continuously from medial side 16 to the top of upper 102. Furthermore, in some cases, ball contacting surface 106 may be disposed on a portion of upper 102 directly above the instep, or top, of a foot. In other cases, ball contacting surface 106 may extend into portions of forefoot region 10 and/or heel region 14.

Generally, any materials may be used for ball contacting surface 106. Examples of different materials include, but are not limited to, roughened leathers, rubbers, silastics, or any synthetic or natural elastomeric material such as styrene-butadiene, or polyurethane. In some embodiments, ball contacting surface 106 may be made from a combination of one or more of such materials.

In some cases, article of footwear 100 also may include textured surface 108. In this embodiment, textured surface 108 is generally located in forefoot region 10 on medial side 16 of article 100. In other embodiments, textured surface 108 may extend into a portion of midfoot region 12. In some embodiments, textured surface 108 may further enhance ball control. In an exemplary embodiment, textured surface 108 may increase the grip of upper 102.

Figure 2:
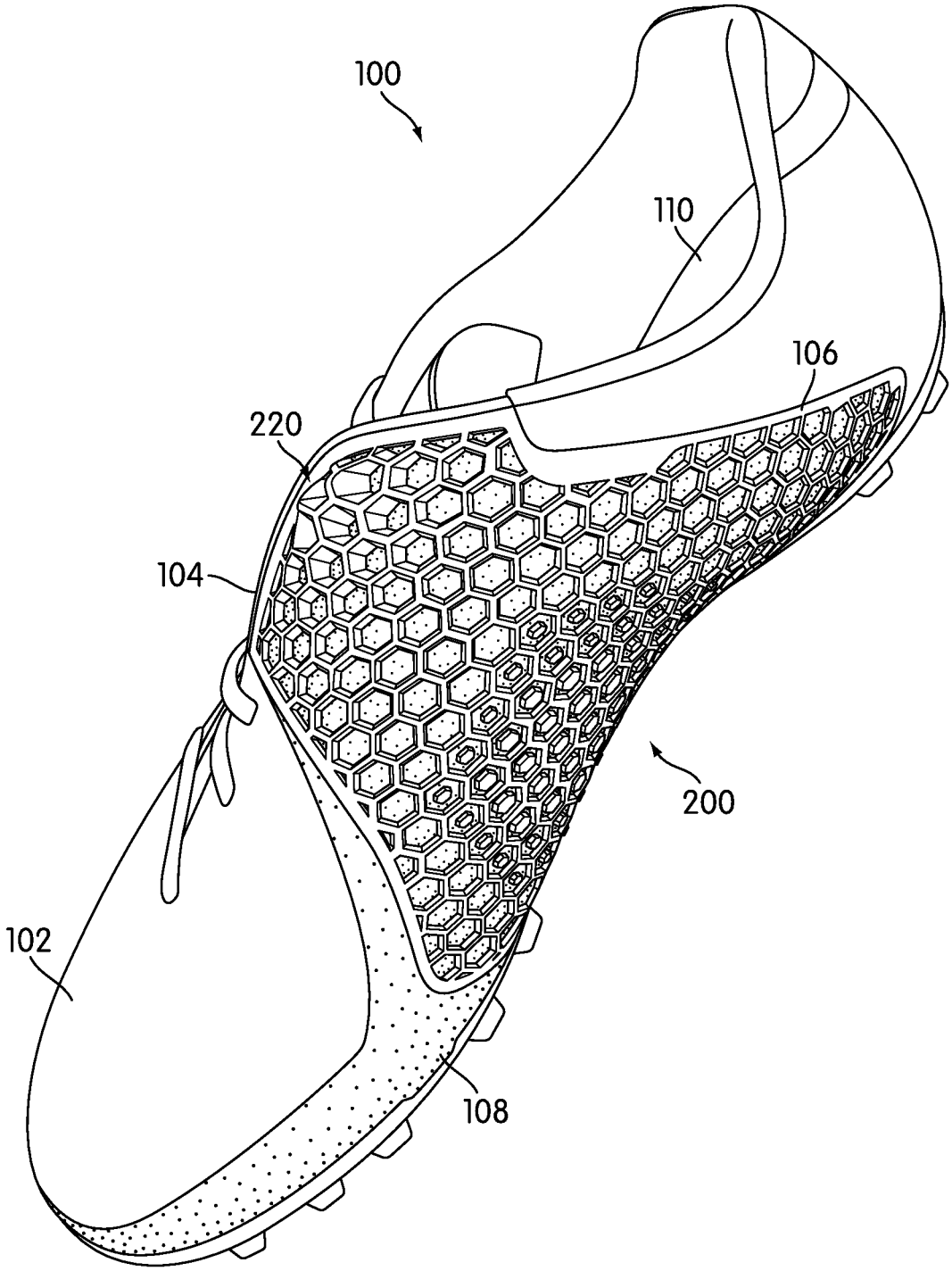
FIG. 2 is an isometric view of an exemplary embodiment of an article of footwear including a ball contacting surface.

Referring now to FIG. 2, article of footwear 100 may include provisions for lowering the trajectory of a kicked ball. In some embodiments, article of footwear 100 may provide a portion of ball contacting surface 106 that is substantially inclined with respect to an outer portion of upper 102 where a ball may contact article 100 during various types of kicks. In one exemplary embodiment, article 100 can include a raised peak member 220 that provides a relatively steep angle for contact with a ball. This configuration may be useful in indoor soccer where the top of the goal is lower than the top of the goal in outdoor soccer, requiring lower trajectories for kicks. In some embodiments, raised peak member 220 may be wedge shaped. In other embodiments, raised peak member 220 may be other shapes, including, but not limited to: pyramidal, trapezoidal, conical, and other geometric and non-geometric shapes.

In some embodiments, article of footwear 100 may provide a portion of ball contacting surface 106 that includes provisions for enhancing the ability to contact and control the ball when kicked. In some cases, ball contacting surface 106 may include a plurality of gripping members 200. Gripping members 200 may be any member disposed on ball contacting surface 106 that are configured to come in contact with a ball during various types of kicks. In an exemplary embodiment, gripping members 200 may include raised portions of ball contacting surface 106. As shown in FIG. 2, in this embodiment, gripping members 200 may have a similar height as ball contactinq surface 106 so that ball contacting surface 106 and gripping members 200 are substantially flush with each other. In some embodiments, gripping members 200 may be designed to make initial contact with a ball before ball contacting surface 106.

Generally, gripping members 200 may be associated with any portion of ball contacting surface 106 on upper 102. In some embodiments, gripping members 200 may be arranged on medial side 16 of article 100. In some embodiments, gripping members 200 additionally may be associated with a portion of midfoot region 12 of article 100. In an exemplary embodiment, gripping members 200 may be disposed on a portion of ball contacting surface 106 associated with the instep of a foot on medial side 16. In other embodiments, gripping members 200 may be associated with one or more portions of forefoot region 10 and/or heel region 14. In further embodiments, gripping members 200 may be arranged on lateral side 18 and/or medial side 16 in any of forefoot region 10, midfoot region 12, and/or heel region 14.

Figure 3:
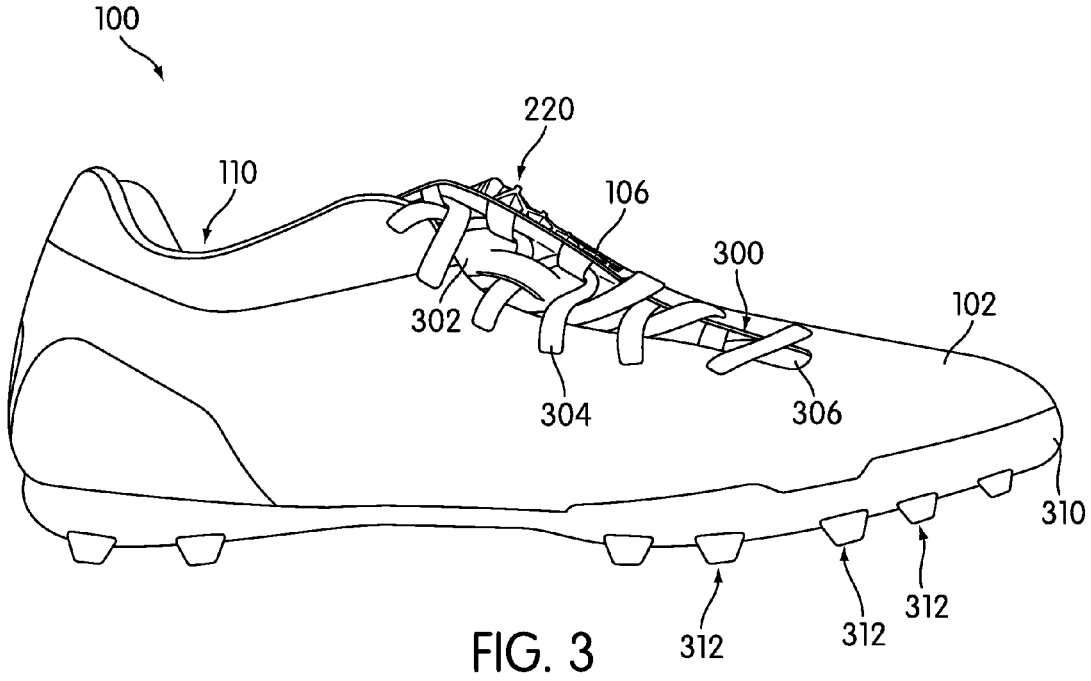
FIG. 3 is a lateral side view of an exemplary embodiment of an article of footwear including a ball contacting surface.

FIG. 3 illustrates lateral side 18 of an exemplary embodiment of article of footwear 100 including ball contacting surface 106. In this embodiment, raised peak member 220 is visible in profile rising above the surface of upper 102. In this embodiment, lateral side 18 of upper 102 does not include ball contacting surface 106. In other embodiments, ball contacting surface 106 may extend to lateral side 18 of upper 102.

In some embodiments, article of footwear 100 may include shoe fastening system 300. Shoe fastening system 300 may be used to tighten upper 102 to a foot. Examples of shoe fastening systems include, but are not limited to, laces, buckles, hook and loop fasteners (such as Velcro®) as well as any other types of fastening systems. In one embodiment, shoe fastening system 300 includes tongue 302 and lace 304. Additionally, shoe fastening system 300 may include tongue opening 306. Tongue opening 306 may be a gap or opening in upper 102 that extends from entry hole 110 into forefoot region 10. In this embodiment, lace 304 may be configured to change the size of tongue opening 306, which may further adjust the size of upper 102. In some embodiments, tongue opening 306 may be spaced from the center of article 100. In one exemplary embodiment, tongue opening 306 may be spaced offset to lateral side 18 of article 100. Using this laterally spaced lacing configuration, shoe fastening system 300 is designed to avoid interference with a ball that may be kicked using vamp portion 104 of upper 102.

Article of footwear 100 may include sole structure 310. In some embodiments, sole structure 310 may be configured to provide traction for article 100. In addition to providing traction, sole structure 310 may attenuate ground reaction forces when compressed between the foot and the ground during walking, running or other ambulatory activities. The configuration of sole structure 310 may vary significantly in different embodiments to include a variety of conventional or non-conventional structures. In some cases, the configuration of sole structure 310 can be configured according to one or more types of ground surfaces on which sole structure 310 may be used. Examples of ground surfaces include, but are not limited to: natural turf, synthetic turf, dirt, as well as other surfaces.

Sole structure 310 is secured to upper 102 and extends between the foot and the ground when article 100 is worn. In different embodiments, sole structure 310 may include different components. For example, sole structure 310 may include an outsole, a midsole, and/or an insole. In some cases, one or more of these components may be optional. Sole structure 310 may be made from any suitable material, including but not limited to elastomers, siloxanes, natural rubber, other synthetic rubbers, aluminum, steel, natural leather, synthetic leather, or plastics.

In some embodiments, sole structure 310 may include cleat members 312 that can enhance traction with the ground. In one embodiment, sole structure 310 includes cleat members 310 that are incorporated into sole structure 310. However, other embodiments may include removable cleat members. In one embodiment, sole structure 310 may use one or more features described in U.S. Pat. No. 6,973,746 to Auger et al, the entirety of which is incorporated by reference. In one embodiment, the cleat assembly described in U.S. Pat. No. 6,973,746 is used in combination with article 100.

Figure 4:
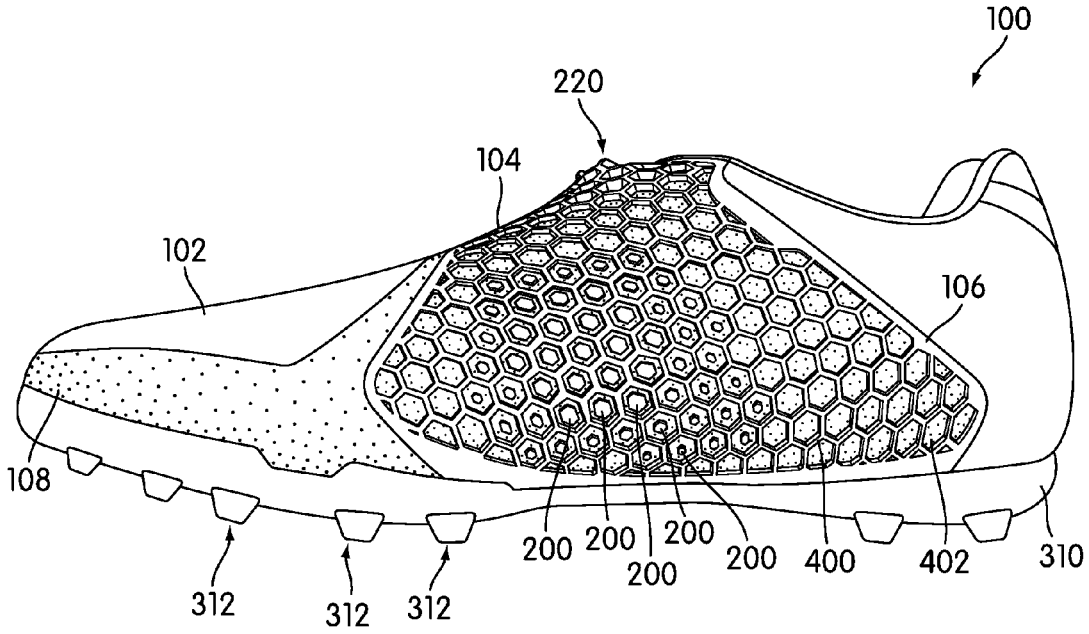
FIG. 4 is a medial side view of an exemplary embodiment of an article of footwear including a ball contacting surface.

Referring now to FIG. 4, medial side 16 of article 100 including ball contacting surface 106 is illustrated. In some embodiments, ball contacting surface 106 may be formed by an overlay 400 disposed over a substrate 402. In one exemplary embodiment, overlay 400 may be formed by a raised material disposed over substrate 402. In some embodiments, overlay 400 may be made of a rigid material. In different embodiments, overlay 400 may be made of any suitable material, including, but not limited to: polyurethane, other elastomers, siloxanes, natural rubber, other synthetic rubbers, natural leather, synthetic leather, or plastics. In some embodiments, substrate 402 may be made of a tactile material that provides grip to a ball. In other embodiments, substrate 402 may be made of any suitable material, including, but not limited to similar materials used to make upper 102 as described above.

In some embodiments, overlay 400 may be arranged over ball contacting surface 106 in a geometric pattern. In one exemplary embodiment, overlay 400 is arranged in a hexagonal or honeycomb pattern. With this arrangement, article 100 may exhibit consistent ball control properties across the majority of ball contacting surface 106. In other embodiments, overlay 400 may be arranged over ball contacting surface 106 in any geometric-shaped pattern, regular pattern, or irregular pattern. In some embodiments, gripping members 200 may be disposed on substrate 402 between portions of overlay 400.

Figure 5:
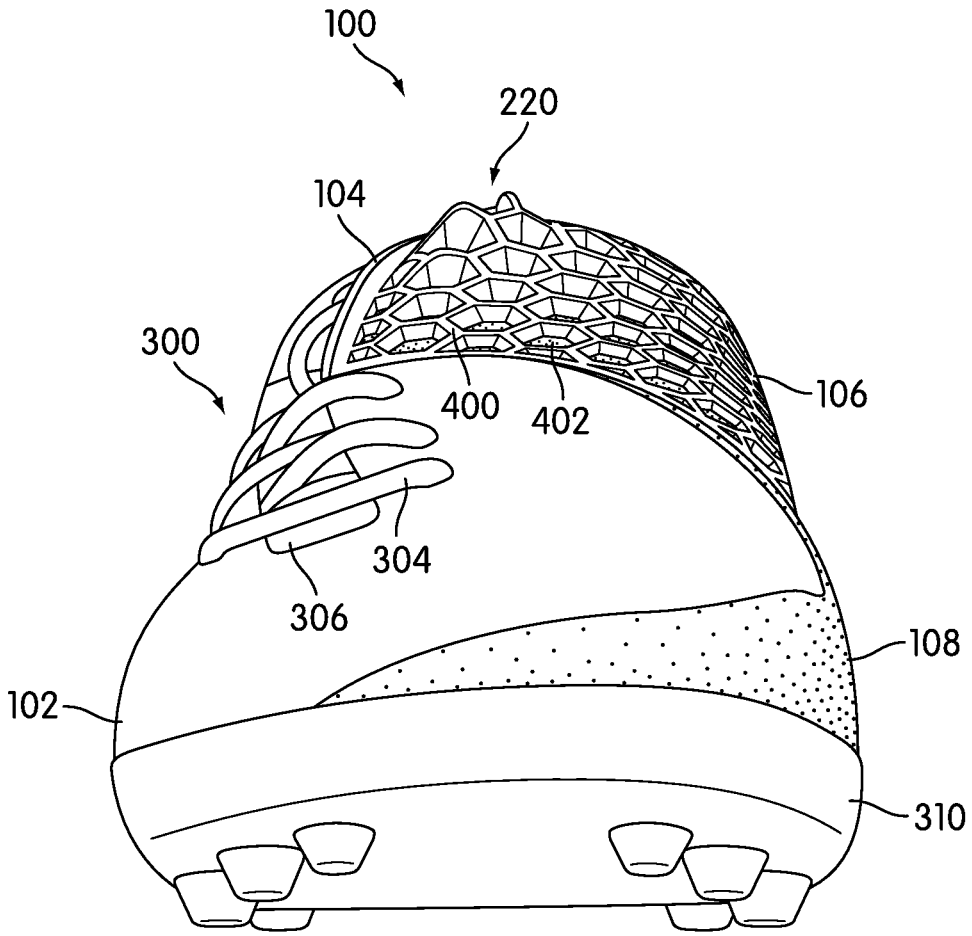
FIG. 5 is a front view of an exemplary embodiment of an article of footwear including a ball contacting surface with a raised peak member.

Referring now to FIG. 5, in some embodiments, overlay 400 may be varied in thickness. In different embodiments, overlay 400 may be varied in thickness at varying portions of ball contacting surface 106. In the exemplary embodiment of FIG. 5, overlay 400 forms raised peak member 220 near the top of vamp portion 104. In this embodiment, raised peak member 220 is formed by a graduated increase in thickness of overlay 400. In this embodiment, shoe fastening system 300 is spaced offset to lateral side 18 of article 100 to avoid interference with a ball that may be hit by raised peak member 220.

Figure 6:
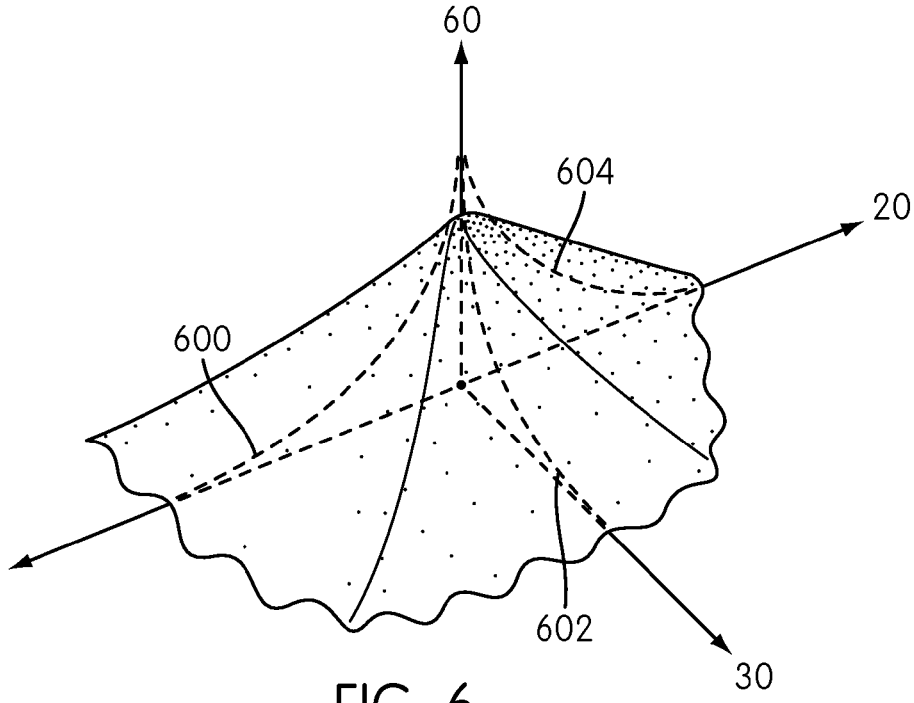
FIG. 6 is a representative view of the contours of an exemplary embodiment of a raised peak member of a ball contacting surface.
Figure 7:
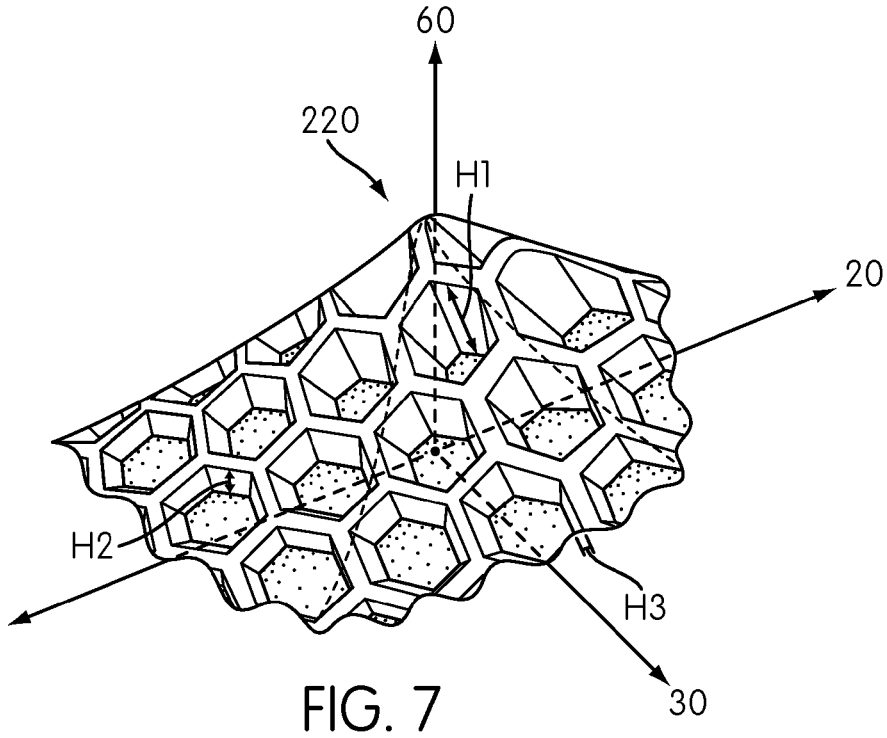
FIG. 7 is a view of an exemplary embodiment of a raised peak of a ball contacting surface.

FIGS. 6 and 7 illustrate a close up view of the geometry of ball contacting surface 106 including raised peak member 220. In some embodiments, ball contacting surface 106 may be curved along longitudinal axis 20 and/or lateral axis 30. In other words, the thickness of overlay 400 of ball contacting surface 106 may vary in a nonlinear manner in the longitudinal and/or lateral directions. In some cases, vamp portion 104 of ball contacting surface 106 may have a substantially concave shape along longitudinal axis 20 and/or lateral axis 30 in a manner that corresponds to the natural curvature of a ball. In other cases, one or more portions of ball contacting surface may have a substantially convex shape along longitudinal axis 20 and/or lateral axis 30.

In different embodiments, the geometry of raised peak member 220 can vary. In some cases, raised peak member 220 has a wedge-like shape that provides an angled surface for contacting a ball during a kick. In particular, FIG. 6 illustrates a representative view of the contours of an exemplary embodiment of raised peak member 220. In this embodiment, raised peak member 220 may be contoured in at least two directions.

As illustrated in FIG. 6, a first contoured surface 600 extends from a height on vertical axis 60 generally along longitudinal axis 20 in a direction towards forefoot region 10. Similarly, a second contoured surface 602 extends from a height on vertical axis 60 generally along lateral axis 30 in a direction towards medial side 16. In some embodiments, raised peak member also may include a third contoured surface 604 that extends from a height on vertical axis 60 generally along longitudinal axis 20 in a direction towards heel region 14. It should be understood that first contoured surface 600, second contoured surface 602, and/or third contoured surface 604 may extend along any portion of longitudinal axis 20, lateral axis 30, and/or vertical axis 60, or any combination thereof.

Referring now to FIG. 7, raised peak member 220 of ball contacting surface 106 is depicted conforming to the geometry of contours illustrated in FIG. 6. In some embodiments, raised peak member 220 may be formed by varying the thickness of overlay 400 of ball contacting surface 106. In this embodiment, the thickness of overlay 400 may vary from a first height H1 at the apex of raised peak member 220 to a second height H2 of ball contacting surface 106 along longitudinal axis 20 in a direction towards forefoot region 10. Similarly, the thickness of overlay 400 may vary from first height H1 at the apex of raised peak member 220 to a third height H3 of ball contacting surface 106 along lateral axis 30 in a direction towards medial side 16. Moreover, first height H1 may be substantially greater than second height H2 and/or third height H3. In different embodiments, overlay 400 also may vary in height from first height H1 along longitudinal axis 20 in a direction towards heel region 14 and/or along lateral axis 30 in a direction towards lateral side 18.

In an exemplary embodiment, first height H1 of raised peak member 220 diminishes in height to second height H2 to form first contoured surface 600 along longitudinal axis 20 in a direction towards forefoot region 10. Similarly, first height H1 of raised peak member 220 diminishes in height to third height H3 to form second contoured surface 602 along lateral axis 30 in a direction towards medial side 16. In other embodiments, raised peak member 220 also may diminish in height along longitudinal axis 20 in a direction towards heel region 14 to form third contoured surface 604. In different embodiments, raised peak member 220 may diminish in height in varying amounts to form varied contoured surfaces along any portion of longitudinal axis 20, lateral axis 30, and/or vertical axis 60, or any combination thereof.

Figure 8:
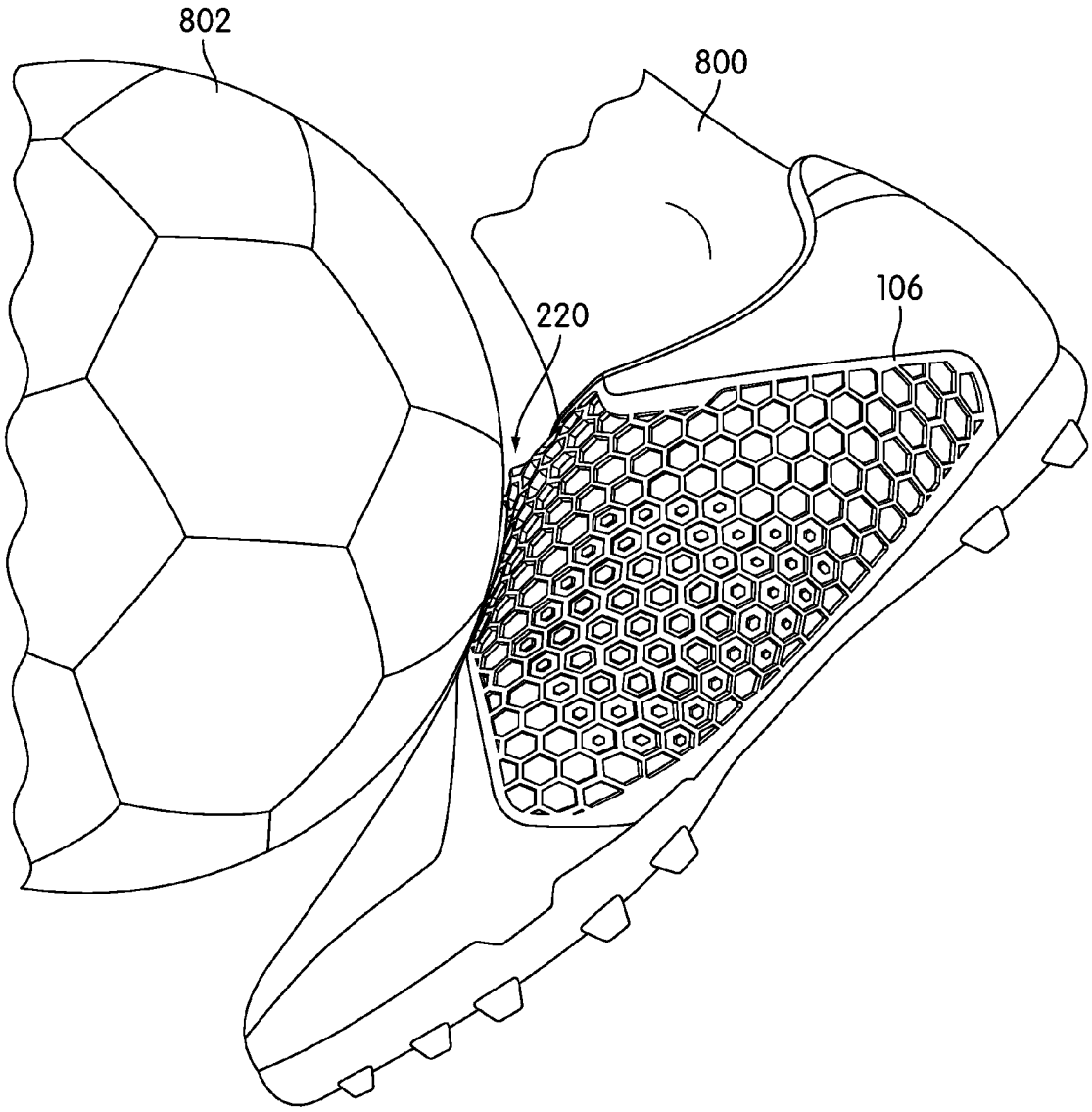
FIG. 8 is a side view of an exemplary embodiment of a ball contacting surface in contact with a ball.

Referring now to FIG. 8, article of footwear 100 worn on a foot 800 is illustrated making contact with a ball 802. In some embodiments, article of footwear 100 may provide a portion of ball contacting surface 106 that is substantially inclined with respect to an outer portion of upper 102 where ball 800 may contact article 100 during various types of kicks. In an exemplary embodiment, ball contacting surface 106 may include raised peak member 220 for lowering the trajectory of a kicked ball. In this embodiment, raised peak member 220 may provide a relatively steep angle for contact with ball 800. In some embodiments, raised peak member 220 may be wedge-shaped. In other embodiments, raised peak member 220 may be other shapes, including, but not limited to: pyramidal, trapezoidal, conical, and other geometric and non-geometric shapes.

Figure 9:
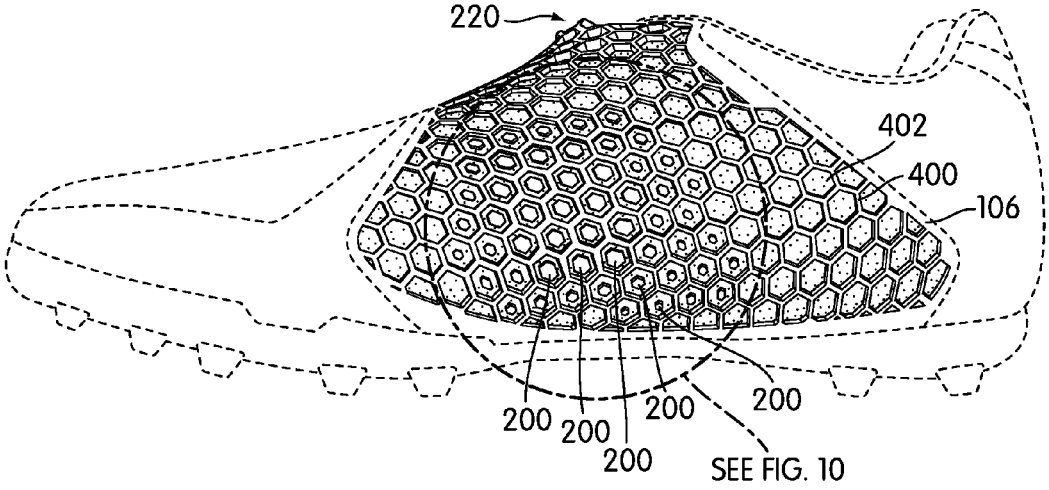
FIG. 9 is a side view of an exemplary embodiment of a medial side of a ball contacting surface.
Figure 10:
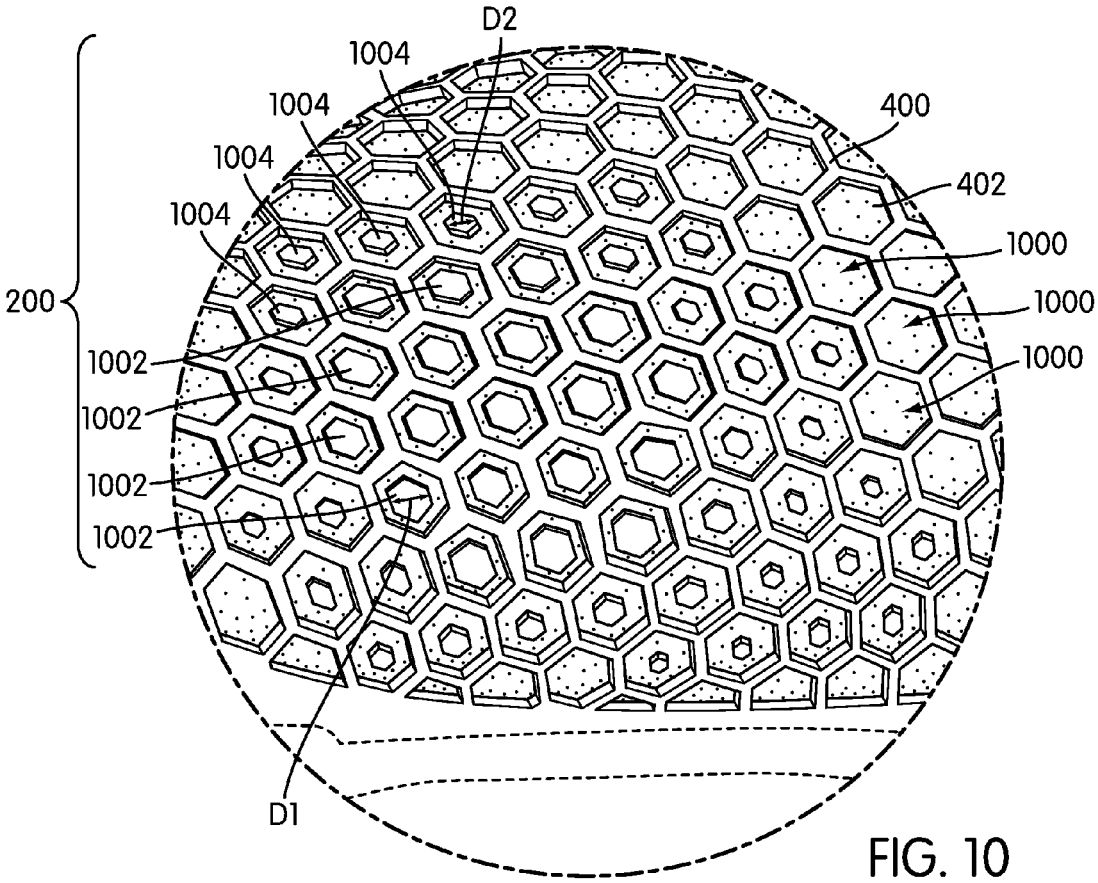
FIG. 10 is a close up view of an exemplary embodiment of a medial side of a ball contacting surface including gripping members.

FIGS. 9 and 10 illustrate an exemplary embodiment of gripping members 200 disposed on ball contacting surface 106. In this embodiment, gripping members 200 may be arranged on medial side 16 of article 100. In some cases, gripping members 200 may be generally associated with a portion of midfoot region 12 of article 100. In other cases, gripping members 200 may be disposed on a portion of ball contacting surface 106 associated with the instep of a foot.

In different embodiments, gripping members 200 provided on ball contacting surface 106 may be made of varying materials including any of the materials used for ball contacting surface 106. In some cases, gripping members 200 may be made of a substantially similar material as ball contacting surface 106. In other cases, gripping members 200 may be made of a substantially different material than ball contacting surface 106. In some embodiments, materials that enhance gripping in wet conditions may be used with ball contacting surface 106 and/or gripping members 200.

Referring now to FIG. 10, in some embodiments, overlay 400 may be disposed over substrate 402 in a pattern forming a plurality of hollows 1000 over ball contacting surface 106. A first set of gripping members 1002 and/or a second set of gripping members 1004 may be disposed on substrate 402 within hollows 1000. It will also be understood that gripping members may be optional on all or portions of ball contacting surface 106.

In some embodiments, first set of gripping members 1002 may be disposed on a portion of ball contacting surface 106. In some cases, first set of gripping members 1002 may be distributed uniformly on ball contacting surface 106. In other cases, first set of gripping members 1002 may be distributed in a non-uniform manner on ball contacting surface 106. In this exemplary embodiment, first set of gripping members 1002 generally have a first size D1. In some embodiments, second set of gripping members 1004 also may be disposed on a portion of ball contacting surface 106. In some cases, second set of gripping members 1004 may be distributed uniformly on ball contacting surface 106. In other cases, second set of gripping members 1004 may be distributed in a non-uniform manner on ball contacting surface 106. In this exemplary embodiment, second set of gripping members 1004 generally have a second size D2. In an exemplary embodiment, first size D1 of first set of gripping members 1002 is larger than second size D2 of second set of gripping members 1004. In other embodiments, first size D1 may be smaller than second size D2. In yet other embodiments, first size D1 and second size D2 may be generally the same size.

In different embodiments, first set of gripping members 1002 and/or second set of gripping members 1004 may vary in size, height, and/or shape. First set of gripping members 1002 and/or second set of gripping members 1004 may be formed in various shapes, including but not limited to hexagons, circles, squares, rectangles, diamonds, ovals, stars, as well as other shapes. Generally, first set of gripping members 1002 and/or second set of gripping members 1004 may be any desired size and may be spaced apart by intervals of varying distances. In some cases, first set of gripping members 1002 and/or second set of gripping members 1004 may be sized and located so that the contact area between first set of gripping members 1002 and/or second set of gripping members 1004 and a ball may be optimized.

In different embodiments, the number of gripping members in first set of gripping members 1002 and/or second set of gripping members 1004 can vary. In some cases, first set of gripping members 1002 may comprise between 1 and 20 gripping members. In other cases, first set of gripping members 1002 can include more than 20 gripping members. In the current embodiment, first set of gripping members 1002 includes 19 gripping members. Also, in some cases, second set of gripping members 1004 can include between 1 and 40 gripping members. In other cases, second set of gripping members 1004 can include more than 40 gripping members. In the current embodiment, second set of gripping members 1004 includes 35 gripping members.

Figure 11:
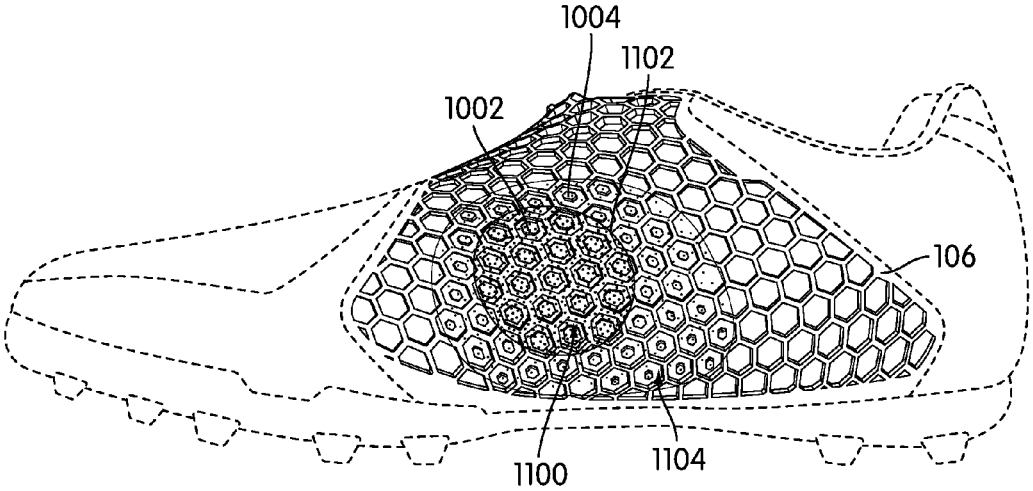
FIG. 11 is a plan view of an arrangement of gripping members on a medial side of a ball contacting surface.

Referring now to FIG. 11, in different embodiments, first set of gripping members 1002 and/or second set of gripping members 1004 may be arranged in patterns on ball contacting surface 106. In an exemplary embodiment, first set of gripping members 1002 may be arranged in a first pattern 1100. In some embodiments, first pattern 1100 of first set of gripping members 1002 may be disposed on a central portion of ball contacting surface 106 on medial side 16 of article 100. In other embodiments, first pattern 1100 may be disposed on various portions of ball contacting surface 106.

In an exemplary embodiment, second set of gripping members 1004 may be arranged in a second pattern 1104. In an exemplary embodiment, second pattern 1104 of second set of gripping members 1004 may be disposed on an outer portion of ball contacting surface 106. In the embodiment of FIG. 11, the outer portion is disposed around the central portion, such that second pattern 1104 surrounds the periphery 1102 of first pattern 1100 of first set of gripping members 1002. In other embodiments, second pattern 1104 may be disposed on various portions of ball contacting surface 106. In some embodiments, the arrangement of first pattern 1100 and/or second pattern may be sized and located so that the contact area with a ball may be optimized.

Figure 12:
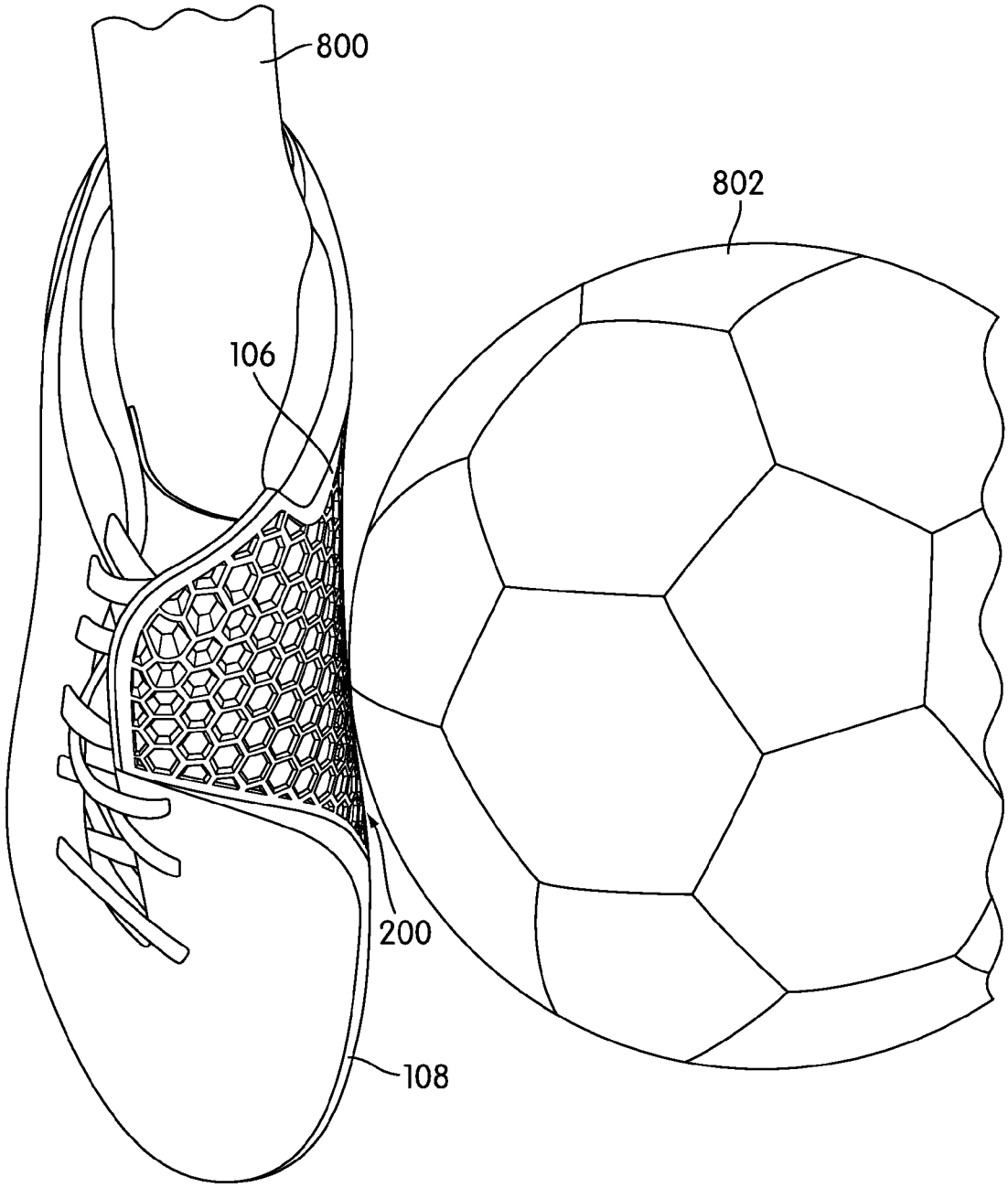
FIG. 12 is a top view of an exemplary embodiment of a ball contacting surface in contact with a ball.

Referring now to FIG. 12, article of footwear 100 worn on a foot 800 is illustrated making contact with ball 802 along medial side 16. In some embodiments, article of footwear 100 may provide a portion of ball contacting surface 106 that is configured to come in contact with ball 802 during various types of kicks. In an exemplary embodiment, ball contacting surface 106 may include gripping members 200 for enhancing the ability to contact and control the ball when kicked. In an exemplary embodiment, gripping members 200 may be disposed along medial side 16 of article 100. In some embodiments, gripping members 200 may be designed to make initial contact with ball 802 before ball contacting surface 106. In other embodiments, gripping members 200 may be designed to make contact with ball 802 at substantially the same time as ball contacting surface 106. For example, as shown in FIG. 2, gripping members 200 have a similar height as the surrounding overlay 400 so as to be substantially flush with ball contacting surface 106.

In some embodiments, gripping members 200 may include provisions that provide the wearer with the ability to apply different types of spin to ball 802. In some embodiments, article of footwear 100 may include gripping members 200 with multiple surface orientations. Generally, elevated gripping members 200 may be provided with surface orientations that maximize the contact area between gripping members 200 and ball 802. In some cases, these gripping member surfaces may be oriented to provide enhanced control of spin of ball 820 during kicking. In particular, multiple surface orientations may be provided for enhanced control of spin of ball 820 with each surface orientation associated with a certain type of kick or spin.

Figure 13:
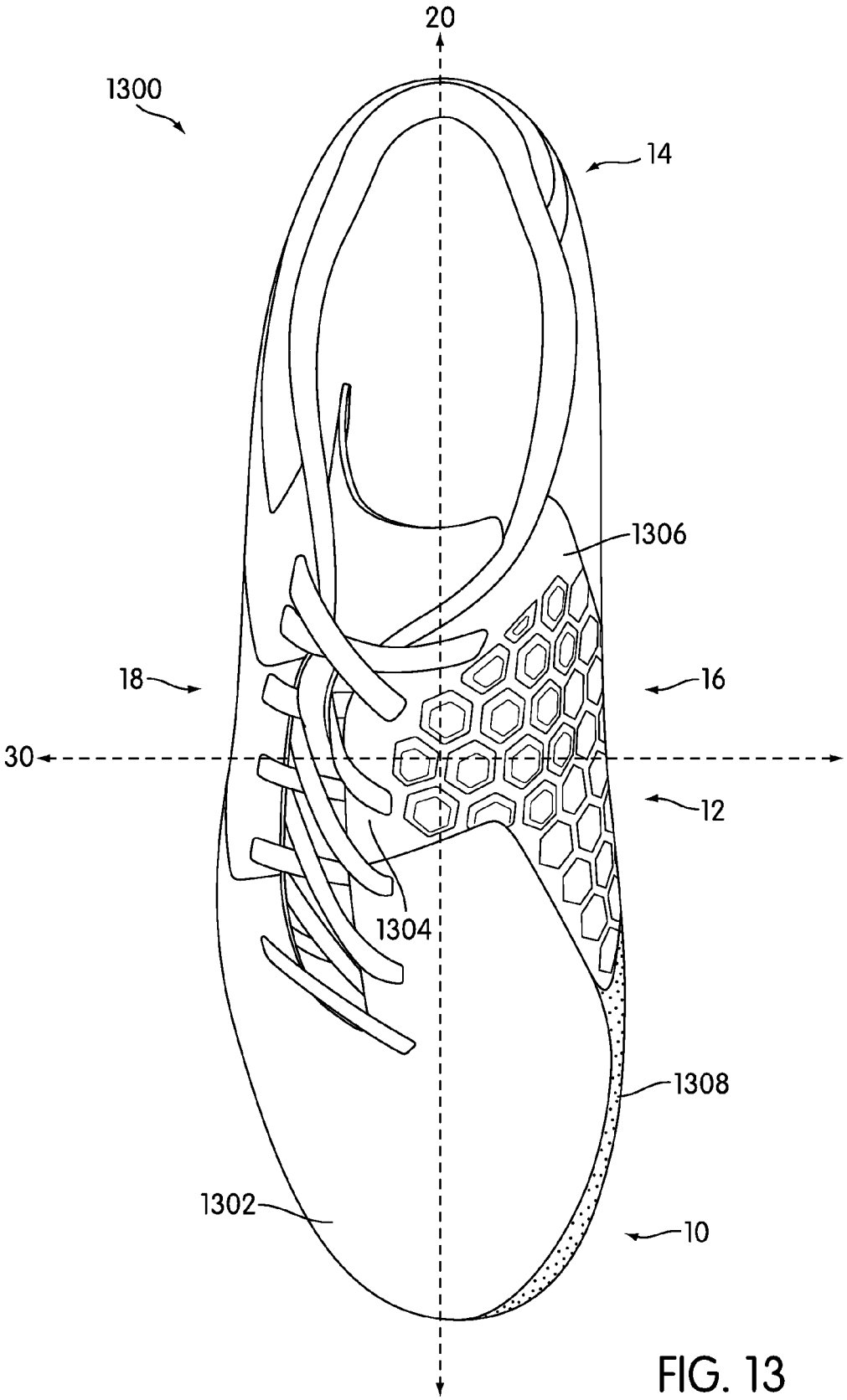
FIG. 13 is a top view of an alternate exemplary embodiment of an article of footwear including a ball contacting surface.

FIGS. 13 through 18 illustrate views of an alternate exemplary embodiment of article of footwear 1300. Referring now to FIG. 13, in this case, article 1300 may be substantially similar to the embodiment of article 100 discussed previously. In this embodiment, article 1300 may include upper 1302 and vamp portion 1304. Upper 1302 and vamp portion 1304 may be substantially similar to the embodiments of upper 102 and vamp portion 104 discussed previously. Furthermore, in this embodiment, article 1300 includes ball contacting surface 1306. Ball contacting surface 1306 may be used to enhance the ability to contact and control the ball when kicked. Generally, ball contacting surface 1306 may be associated with any portion of upper 1302. In some cases, ball contacting surface 1306 may be associated with midfoot region 12 of upper 1302. In some embodiments, ball contacting surface 1306 may extend from medial side 16 to the top of upper 1302. In an exemplary embodiment, ball contacting surface 1306 extends substantially continuously from medial side 16 to the top of upper 1302. Furthermore, in some cases, ball contacting surface 1306 may be disposed on a portion of upper 1302 directly above the instep, or top, of a foot. In other cases, ball contacting surface 1306 may extend into portions of forefoot region 10 and/or heel region 14.

Generally, any materials discussed previously in regard to ball contacting surface 106 may be used for ball contacting surface 1306. Examples of different materials include, but are not limited to, roughened leathers, rubbers, silastics, or any synthetic or natural elastomeric material such as styrene-butadiene, or polyurethane. In some embodiments, ball contacting surface 1306 may be made from a combination of one or more of such materials. In one embodiment, ball contacting surface 1306 may include a first portion located generally on top of upper 1302 that is made of padded natural or synthetic leather. Ball contacting surface 1306 also may include a second portion located generally on medial side 16 of upper 1302 that is made of a screen printed or applied layer of tactile material. Generally, any suitable tactile material may be used, including, but not limited to: rubbers, silastics, or any synthetic or natural elastomeric material.

Figure 14:
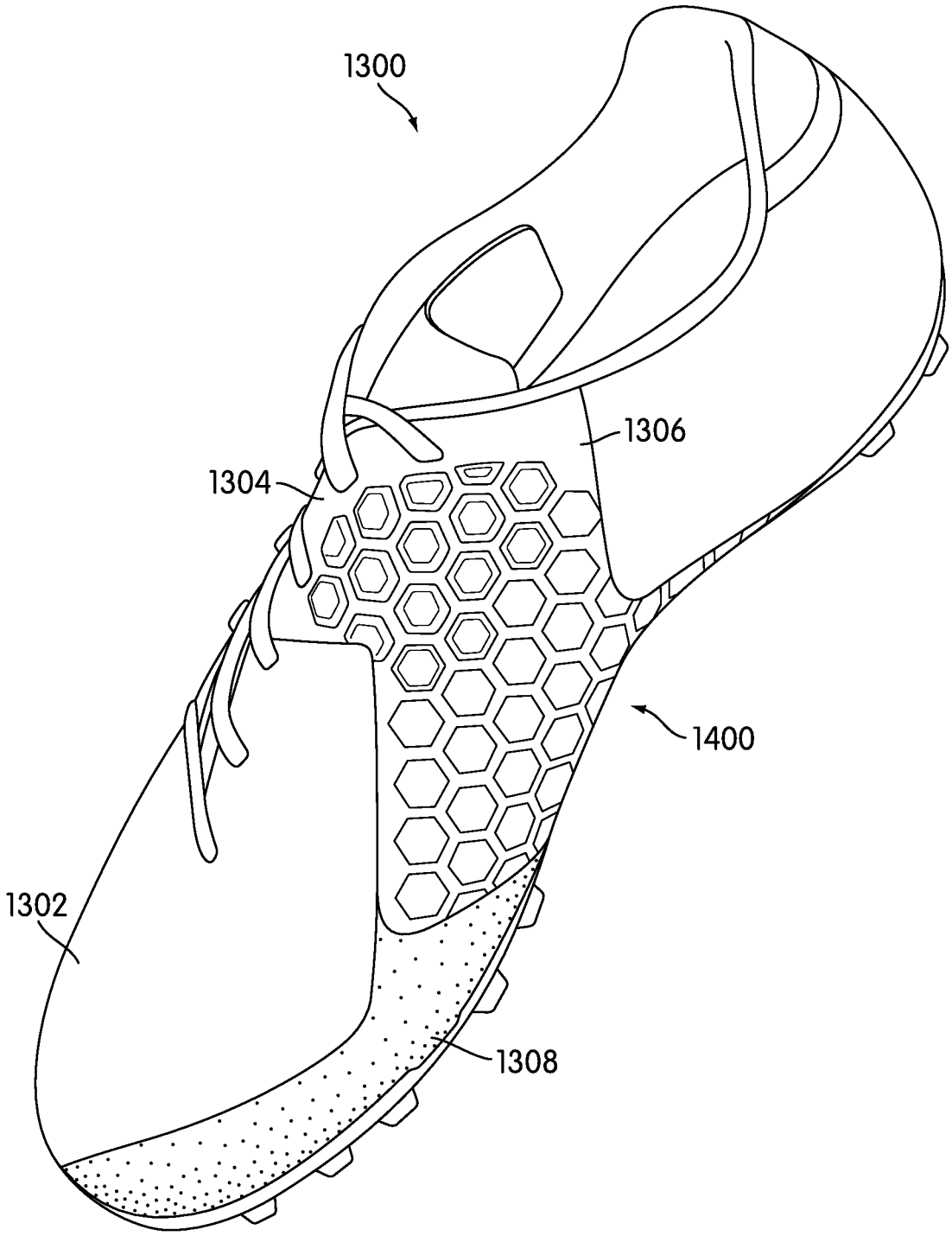
FIG. 14 is an isometric view of an alternate exemplary embodiment of an article of footwear with a ball contacting surface.

Referring now to FIG. 14, in some cases, article of footwear 1300 also may include textured surface 1308. In this embodiment, textured surface is generally located in forefoot region 10 on medial side 16 of article 1300. In other embodiments, textured surface may extend into a portion of midfoot region 12. In some embodiments, textured surface 1308 may further enhance ball control. In an exemplary embodiment, textured surface 1308 may increase the grip of upper 1302. In some embodiments, textured surface 1308 may be formed integrally with a portion of ball contacting surface 1306. In different embodiments, textured surface 1308 may be formed from any of the materials used to form ball contacting surface 1306. In some embodiments, textured surface 1308 may have a different amount of grip or tackiness than ball contacting surface 1306. In some cases, textured surface 1308 may have more or less grip than ball contacting surface 1306. In other cases, textured surface 1308 and ball contacting surface 1306 may have substantially similar amounts of grip. In one exemplary embodiment, textured surface 1308 may be a rougher surface than ball contacting surface 1306.

As shown in FIG. 14, a portion of ball contacting surface 1306 may include a plurality of gripping members 1400 disposed on medial side 16 of upper 1302. In some embodiments, gripping members 1400 additionally may be associated with a portion of midfoot region 12 of article 1300. In an exemplary embodiment, gripping members 1400 may be disposed on a portion of ball contacting surface 1306 associated with the instep of a foot on medial side 16. In other embodiments, gripping members 1400 may be associated with one or more portions of forefoot region 10 and/or heel region 14. In further embodiments, gripping members 1400 may be arranged on lateral side 18 and/or medial side 16 in any of forefoot region 10, midfoot region 12, and/or heel region 14.

In some embodiments, gripping members 1400 may be made from a screen printed or applied layer of tactile material. Generally, any suitable tactile material may be used, including, but not limited to: rubbers, silastics, or any synthetic or natural elastomeric material. In other embodiments, gripping members 1400 may be made from any material used to make upper 1302. Gripping members 1400 may be formed in various shapes, including but not limited to hexagons, circles, squares, rectangles, diamonds, ovals, stars, as well as other shapes.

Generally, gripping members 1400 may be any desired size and may be spaced apart by intervals of varying distances. In some cases, gripping members 1400 may be sized and located so that the contact area with a ball may be optimized. In other embodiments, gripping members 1400 may include one or more different sets of gripping members that are disposed on various portions of ball contacting surface 1306. In some embodiments, gripping members 1400 may be disposed over ball contacting surface 1306 in a geometric pattern. In one exemplary embodiment, gripping members 1400 are arranged in a hexagonal or honeycomb pattern. With this arrangement, article 1300 may exhibit consistent ball control properties across the majority of ball contacting surface 1306. In other embodiments, gripping members 1400 may be arranged over ball contacting surface 1306 in any geometric-shaped pattern, regular pattern, or irregular pattern. It will also be understood that gripping members 1400 may be optional on all or portions of ball contacting surface 1306.

Figure 15:
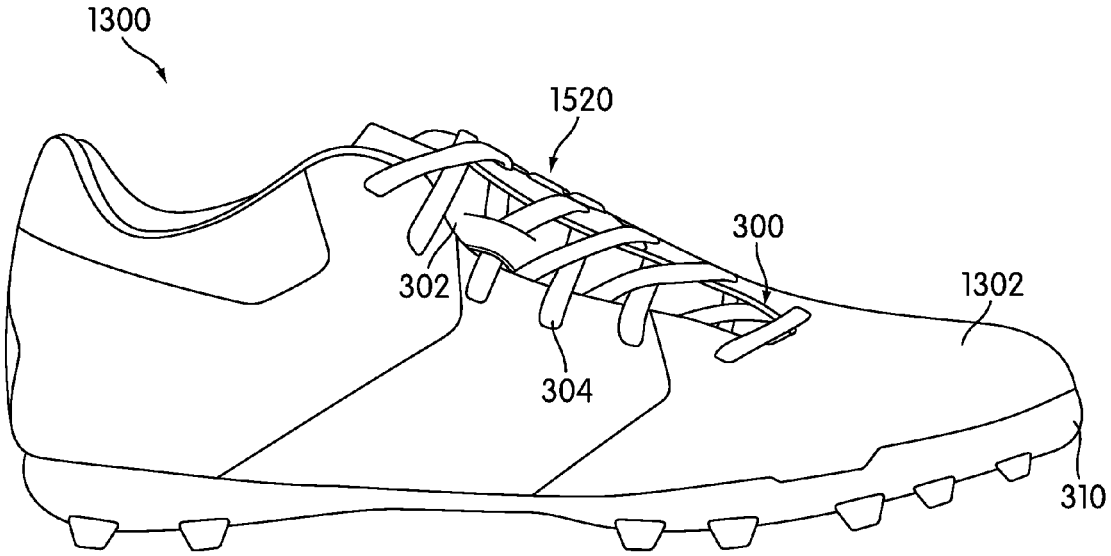
FIG. 15 is a lateral side view of an alternate exemplary embodiment of an article of footwear including a ball contacting surface.

FIG. 15 illustrates lateral side 18 of an alternate exemplary embodiment of article of footwear 1300 including ball contacting surface 1306. In this embodiment, raised peak member 1520 is visible in profile rising above the surface of upper 1302. In this embodiment, lateral side 18 of upper 1302 does not include ball contacting surface 106. In other embodiments, ball contacting surface 1306 may extend to lateral side 18 of upper 1302. In some embodiments, article of footwear 1300 may include shoe fastening system 300 and/or sole structure 310, discussed previously.

Figure 16:
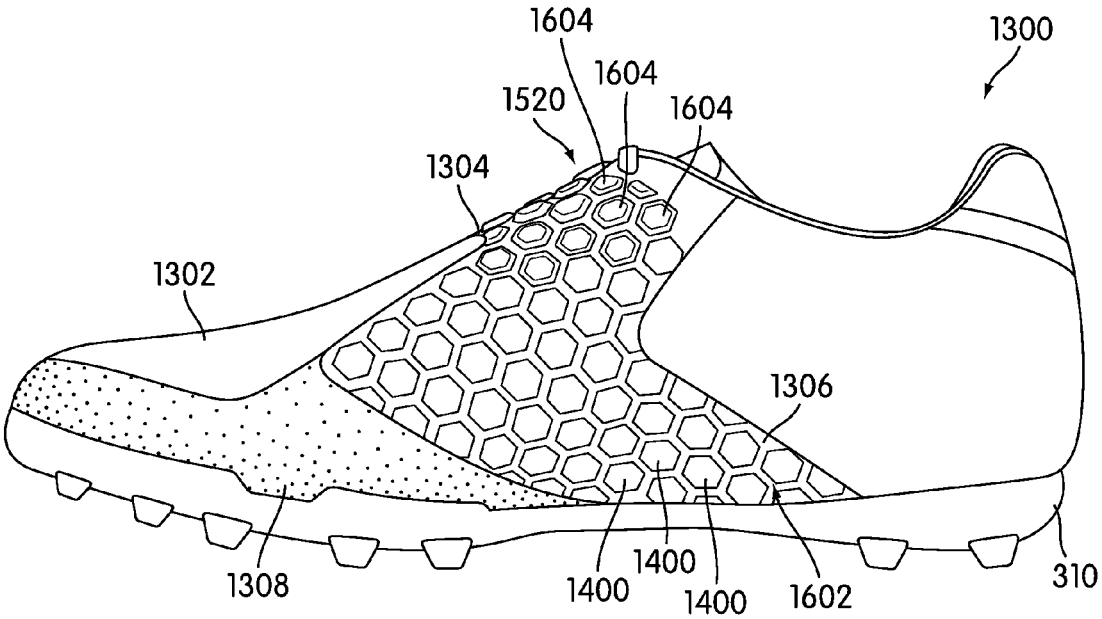
FIG. 16 is a medial side view of an alternate exemplary embodiment of an article of footwear including a ball contacting surface.

Referring now to FIG. 16, medial side 16 of article 1300 including ball contacting surface 1306 is illustrated. In some embodiments, ball contacting surface 1306 may include a plurality of padded members 1604 disposed over a first portion of vamp portion 1304 located generally on top of upper 1302. Padded members 1604 may be made of any material used for ball contacting surface 1306 and/or upper 1302. In some embodiments, padded members 1604 may be made of natural or synthetic leather. In an exemplary embodiment, padded members 1604 also may include foam or other suitable padding material disposed under natural or synthetic leather. In other embodiments, padded members 1604 may be formed by an overlay disposed over a substrate material.

In some embodiments, padded members 1604 may form a raised peak member 1520 that provides a relatively steep angle for contact with a ball. This configuration may be useful in indoor soccer where the top of the goal is lower than the top of the goal in outdoor soccer, requiring lower trajectories for kicks. In some embodiments, raised peak member 1520 may be wedge shaped. In other embodiments, raised peak member 1520 may be other shapes, including, but not limited to: pyramidal, trapezoidal, conical, and other geometric and non-geometric shapes.

In some embodiments, ball contacting surface 1306 also may include a second portion located generally on medial side 16 of upper 1302 that contains the plurality of gripping members 1400. In one exemplary embodiment, gripping members 1400 may be formed by a printed tactile material disposed over a substrate 1602. In some embodiments, substrate 1602 may be made of a smooth material. In other embodiments, substrate 1602 may be made of a tactile material. In different embodiments, substrate 1602 may have a different amount of grip or tackiness than gripping members 1400. In some cases, substrate 1602 may have less grip than gripping members 1400. In other cases, substrate 1602 and gripping members 1400 may have substantially similar amounts of grip. In other embodiments, substrate 1602 may be made of any suitable material, including, but not limited to similar materials used to make upper 1302 as described above.

Figure 17:
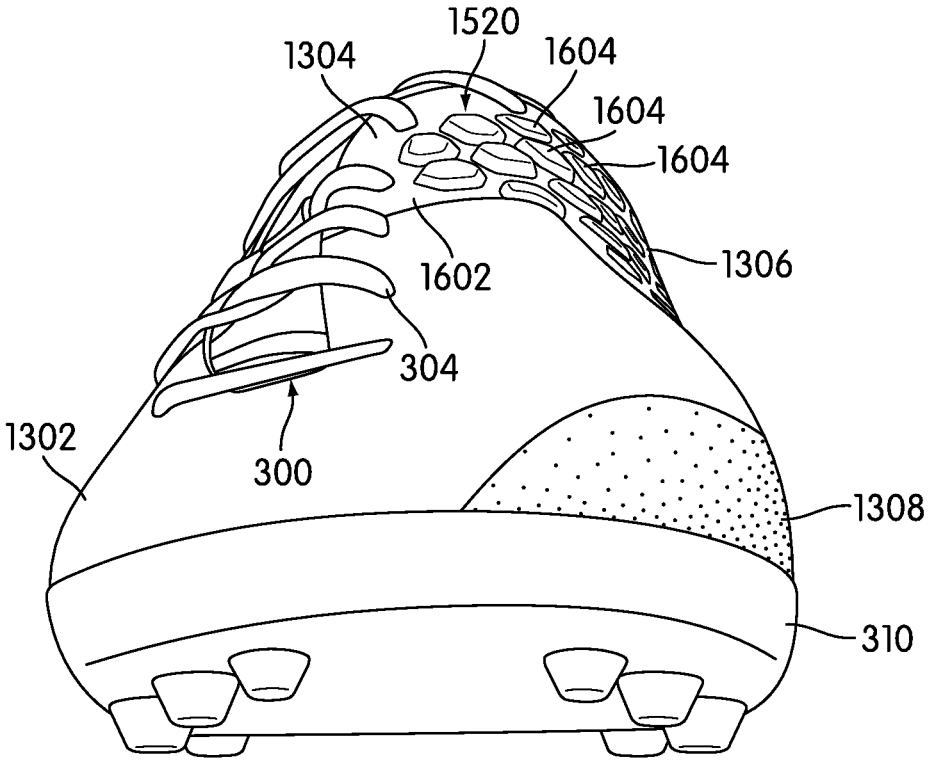
FIG. 17 is a front view of an alternate exemplary embodiment of an article of footwear including a ball contacting surface with a raised peak member.

Referring now to FIG. 17, in some embodiments, padded members 1604 may be varied in thickness. In different embodiments, padded members 1604 may be varied in thickness at varying portions of ball contacting surface 1306. In the exemplary embodiment of FIG. 17, padded members 1604 form raised peak member 1520 near the top of vamp portion 1304. In this embodiment, raised peak member 1520 is formed by a graduated increase in thickness of padded members 1604. In this embodiment, shoe fastening system 300 is spaced offset to lateral side 18 of article 1300 to avoid interference with a ball that may be hit by raised peak member 1520.

Figure 18:
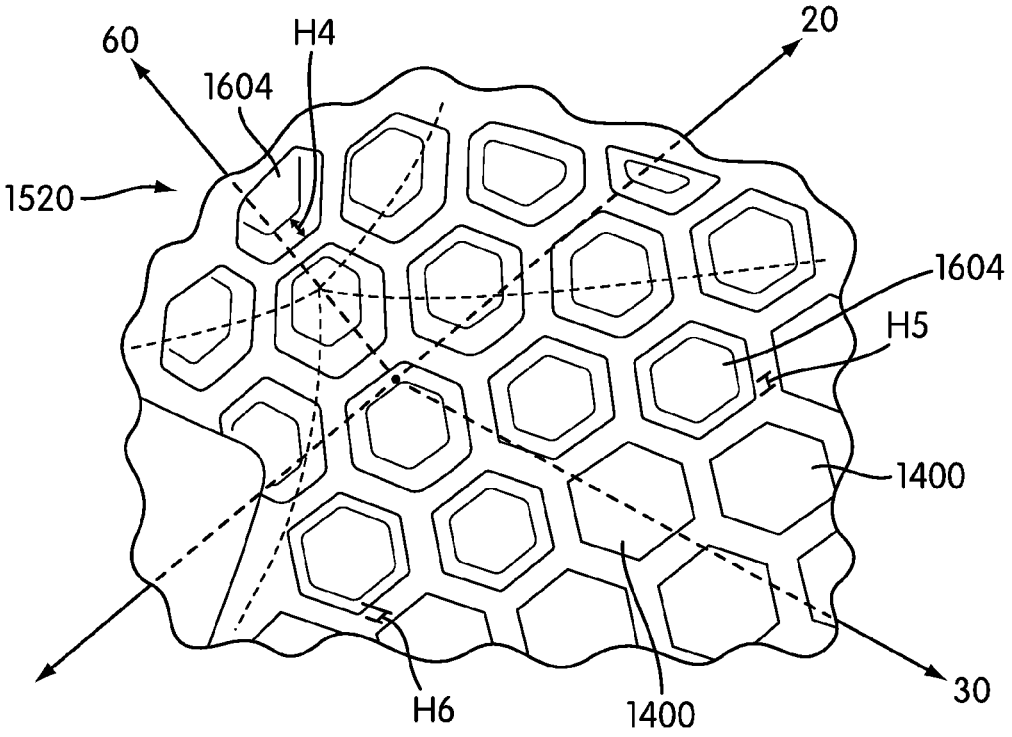
FIG. 18 is a view of an alternate exemplary embodiment of a raised peak member of a ball contacting surface.

Referring now to FIG. 18, raised peak member 1520 of ball contacting surface 1306 is depicted conforming to the geometry of contours illustrated in FIG. 6. In some embodiments, raised peak member 1520 may be formed by varying the thickness of padded members 1604 disposed over ball contacting surface 1306. In this embodiment, the thickness of padded members 1604 may vary from a fourth height H4 at the apex of raised peak member 1520 to a fifth height H5 along lateral axis 30 in a direction towards medial side 16. Similarly, the thickness of padded members 1604 may vary from fourth height H4 at the apex of raised peak member 1520 to a sixth height H6 along longitudinal axis 20 in a direction towards forefoot region 10. Moreover, fourth height H4 may be substantially greater than fifth height H5 and/or sixth height H6. In different embodiments, padded members 1604 also may vary in height along longitudinal axis 20 in a direction towards heel region 14 and/or along lateral axis 30 in a direction towards lateral side 18. In different embodiments, raised peak member 1520 may diminish in height in varying amounts to form varied contoured surfaces along any portion of longitudinal axis 20, lateral axis 30, and/or vertical axis 60, or any combination thereof, as previously discussed with regard to the embodiment of raised peak member 220.

Figure 19:
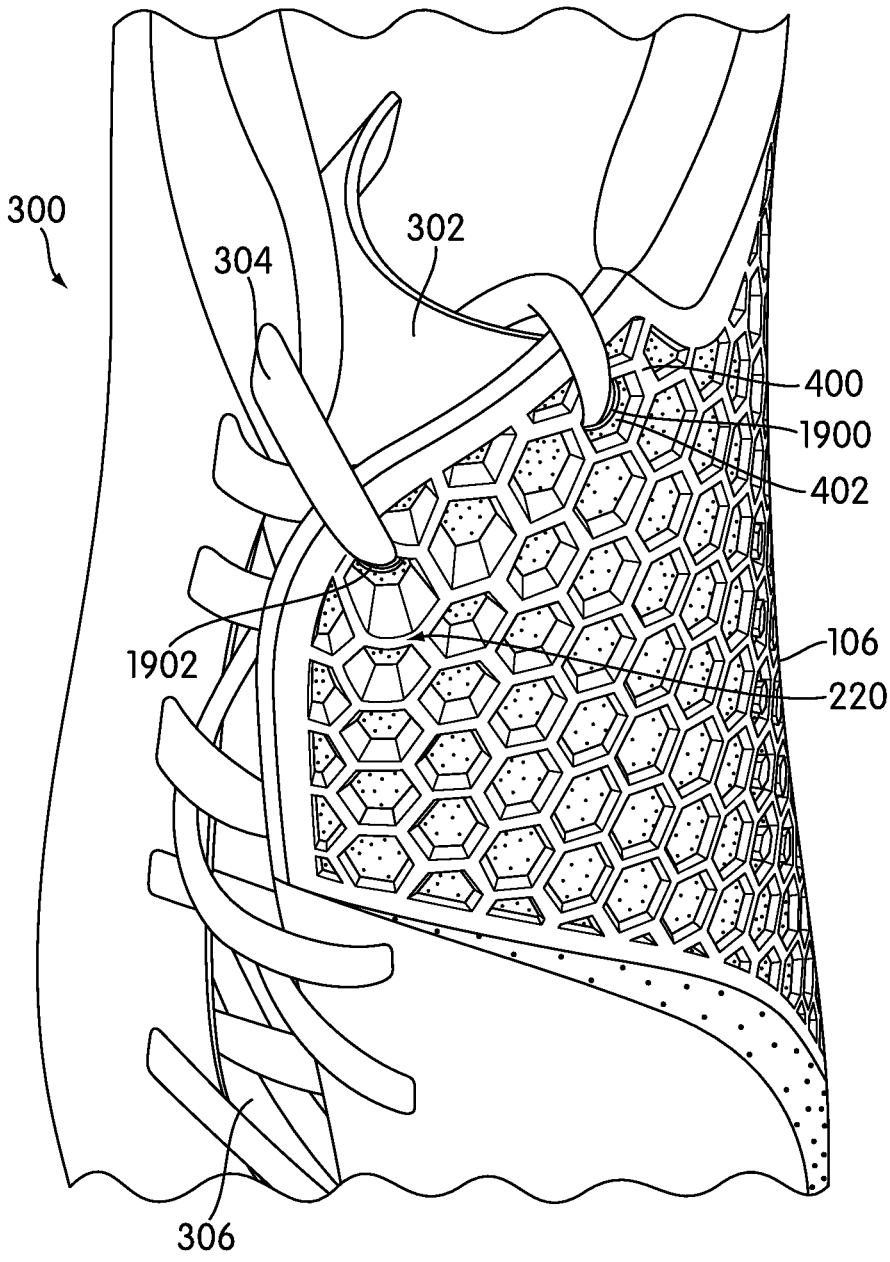
FIG. 19 is a top view of an alternate embodiment of a shoe fastening system for an article of footwear including a ball contacting surface.

Referring now to FIG. 19, an alternate embodiment of shoe fastening system 300 is illustrated for use with article of footwear 100 including ball contacting surface 106. In some embodiments, shoe fastening system 300 may include provisions to tighten article 100 around a foot, including, but not limited to, one or more of: laces, buckles, hook and loop fasteners (such as Velcro®) as well as any other types of fastening systems. In an exemplary embodiment, shoe fastening system 300 may include tongue 302, lace 304, and tongue opening 306, as discussed above in regard to FIG. 3.

In some embodiments, shoe fastening system 300 may be configured to attach to one or more portions of ball contacting surface 106. In one embodiment, shoe fastening system 300 may include one or more eyelets disposed in ball contacting surface 106. The term "eyelet" as used throughout this detailed description and in the claims refers to a structure configured to receive a lace in an article of footwear. In some embodiments, an eyelet may be a small hole or perforation. In some cases, an eyelet may be a hole that is reinforced with a material, including but not limited to: metal, cord, fabric or leather. In other embodiments, an eyelet may be an opening formed by a loop of material including but not limited to: fabric, cord, leather or metal.

In one embodiment, a first eyelet 1900 may be disposed in substrate 402 of ball contacting surface 106 between portions of overlay 400. In this embodiment, a second eyelet 1902 also may be disposed in substrate 402 of ball contacting surface 106. With this arrangement, shoe fastening system 300 may secure ball contacting portion 106 to article 100 using lace 304 disposed through one or more of first eyelet 1900 and second eyelet 1902.

In some embodiments, one or more of the eyelets disposed on ball contacting surface 106 may be arranged so that lace 304 does not interfere with ball contacting surface 106 when contacting a ball. In one embodiment, one or more of first eyelet 1900 and second eyelet 1902 may be arranged near an outer periphery of ball contacting surface 106. In an exemplary embodiment, second eyelet 1902 may be located behind raised peak member 220. With this arrangement, lace 304 may be disposed through first eyelet 1900 and/or second eyelet 1902 and may be used to tighten shoe fastening system 300 to ball contacting surface 106. In other embodiments, additional eyelets may be included on portions of ball contacting surface 106. Additionally, one or more eyelets may be used with any of the embodiments of ball contacting surface described herein, including ball contacting surface 1306 on article 1300 described above.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

an upper including a forefoot region, a heel region and a midfoot region disposed between the forefoot region and the heel region;

a ball contacting surface disposed on the upper of the article of footwear, the ball contacting surface including a raised peak member disposed at a top portion of the upper adjacent to an entry hole for receiving a foot within the upper, said raised peak member having a first height at an apex of said raised peak member;

wherein said raised peak member diminishes from the first height to a second height that is smaller than the first height following a first contour along the longitudinal axis in the direction of the forefoot region;

wherein said raised peak member diminishes from the first height to a third height that is smaller than the first height following a second contour along the lateral axis in the direction of a medial side of the article of footwear;

the first contour and the second contour converging together at the apex of said peak member; and wherein said raised peak member is substantially concave along the first contour along the longitudinal axis in the direction of the forefoot region and is substantially concave along the second contour along the lateral axis in the direction of the medial side; and wherein the ball contacting surface and said raised peak member are comprised of an overlay disposed over a substrate material; wherein the overlay is arranged in a geometric pattern over the substrate; and wherein the thickness of the overlay forms the first height, the second height, and the third height.

2. The article of footwear according to claim 1, wherein said raised peak member is substantially wedge-shaped.

3. The article of footwear according to claim 1, wherein said raised peak member is disposed in front of the entry hole of the upper.

4. The article of footwear according to claim 1, wherein the ball contacting surface is disposed over a portion of the upper in the midfoot region.

5. The article of footwear according to claim 1, wherein the ball contacting surface and said raised peak member are made of a substantially rigid material.

6. An article of footwear, comprising:

an upper;

a sole;

a ball contacting surface disposed over a portion of the upper;

the ball contacting surface comprising a vamp portion including a raised peak member and a medial side portion;

wherein said raised peak member is disposed at a top of the vamp portion adjacent to an entry hole for receiving a foot within the upper;

wherein the ball contacting surface is formed by a substantially continuous raised overlay material extending from the medial side portion adjacent to the sole and across the top of the vamp portion; and wherein said raised peak member is formed by a portion of the raised overlay material having a graduated increase in thickness at the vamp portion such that said raised peak member has at least two substantially concave contours extending from an apex of the said raised member along different directions, including (1) a first concave contour along a longitudinal axis in the direction of a forefoot region of the article of footwear, and (2) a second concave contour along a lateral axis in the direction of a medial side of the article of footwear; and wherein the raised overlay material is arranged in a geometric pattern over a lower substrate material of the upper; and wherein the geometric pattern of the raised overlay material extends through the graduated increase in thickness at the vamp portion forming said raised peak member.

7. The article of footwear according to claim 6, wherein said raised peak member diminishes from a first height to a second height along the longitudinal axis in the direction of the forefoot region of the article of footwear; and wherein said raised peak member diminishes from the first height to a third height along the lateral axis in the direction of the medial side of the article of footwear.

8. The article of footwear according to claim 6, wherein the ball contacting surface is disposed over the portion of the upper in a midfoot region of the article of footwear.

9. The article of footwear according to claim 6, wherein the raised overlay material comprises a substantially rigid material.

10. The article of footwear according to claim 6, wherein said raised peak member is substantially wedge-shaped.

11. An article of footwear, comprising:

an upper;

a ball contacting surface disposed over an exterior of the article of footwear, including a portion of a medial side of the upper;

the ball contacting surface comprising a raised overlay material and a lower substrate material;

wherein the raised overlay material is substantially continuous across the portion of the medial side of the upper;

the lower substrate material forming a plurality of hollows between portions of the raised overlay material;

wherein the ball contacting surface includes a plurality of gripping members disposed on the lower substrate material within the plurality of hollows; and wherein the plurality of gripping members are substantially flush with the raised overlay material; and wherein the raised overlay material is arranged in a first patter; and wherein the gripping members are arranged in a second pattern; wherein the gripping members further comprise: a set of gripping members having a first size; a second set of gripping member having a second size; and wherein the first size is larger than the second size; wherein the second pattern further comprises: the first set of gripping members disposed in a central portion of the ball contacting surface, the second set of gripping members disposed in an outer portion of the ball contacting surface; and wherein the outer portion surrounds the periphery of the central portion.

12. The article of footwear according to claim 11, wherein the second pattern is arranged in an area of the ball contacting surface corresponding to an instep of a foot of a wearer.

13. The article of footwear according to claim 11, wherein the raised overlay material and the gripping members are made of a substantially rigid material.

14. The article of footwear according to claim 11, wherein the ball contacting surface is disposed in a midfoot region of the article of footwear; and wherein a textured surface is disposed over a portion of the medial side of the upper in a forefoot region of the article of footwear.

* * * * *